US005346087A

United States Patent [19]

Klein

[11] Patent Number: 5,346,087

[45] Date of Patent: Sep. 13, 1994

[54] REINFORCED BEVERAGE CAN END WITH PUSH DOWN GATE

[76] Inventor: Gerald B. Klein, 13451 Stuart Ct., Broomfield, Colo. 80020-5531

[21] Appl. No.: 95,741

[22] Filed: Jul. 23, 1993

[51] Int. Cl.[5] ..... B65D 17/32

[52] U.S. Cl. ..... 220/268; 220/269; 220/718

[58] Field of Search ..... 220/266, 268, 269, 716, 220/718, 270, 271, 272, 273, 276

[56] References Cited

U.S. PATENT DOCUMENTS

| | | | |
|---|---|---|---|
| 3,905,513 | 9/1975 | Klein | 220/268 |
| 4,244,490 | 1/1981 | Klein | 220/268 |
| 4,976,368 | 12/1990 | Klein | 220/268 |
| 5,069,356 | 12/1991 | Zysset | 220/276 |

*Primary Examiner*—Allan N. Shoap
*Assistant Examiner*—Nova Stucker
*Attorney, Agent, or Firm*—Wegner, Cantor, Mueller & Player

[57] ABSTRACT

A beverage can end for connection with a can body having a necked-down top, and wherein the center expansion panel of the end forms a gate which is pushed downwardly into the can to open it. This provides, essentially, an open-top-can wherefrom a beverage may be drunk in the same manner as if it were a glass or a cup. The can end, of drawn metal, includes a triple fold reinforcement ring constituting a chuck panel adjacent to the chuck wall of the peripheral seaming ring of the end. The upper layer of the triple fold connects with the bottom of the chuck wall and the lower layer with the center expansion panel. A score-cut about the underside of the lower layer, with a short uncut portion forming a hinge, permits the center expansion panel to be separated from the triple fold and pushed downwardly to open the can. A modified embodiment of this end restricts the score-cut to a segment of the triple fold ring whereby only a portion of the center expansion panel may be pushed downwardly to form an opening at one side of the can end.

19 Claims, 6 Drawing Sheets

REINFORCED BEVERAGE CAN END WITH PUSH DOWN GATE

BACKGROUND OF THE INVENTION

This invention relates to beverage cans and can ends and more particularly to a beverage can end which is made of thin metal having a reinforcing peripheral structure and a gated opening comprising a large portion of, or all of, the center expansion panel.

The invention is especially suitable for drawn aluminum or steel cans for carbonated soft drinks and beer and more especially for drawn can bodies having necked-down tops. The necked-down body tops, reducing the size of the opening, permits the use of a smaller diameter can end formed of thinner metal. The economic advantages of this expedient are obvious and significant considering the amount of metal saved in the large number of cans manufactured each year. This savings suggests that the necked-down body top might be extended to reduce even further the size of the can opening and permit the use of a can end of even thinner metal having an even smaller diameter.

However, several factors prevent this reduction. First, the current lever-operated stay-on tabs, which are attached with a center panel rivet, would have to be formed with a lever and aperture too small to be practical for a gripping and lifting of the lever and for pouring or drinking directly from the can. Secondly, the conventional construction of an end will not permit the use of a significantly thinner metal because of internal pressures generated, as by carbonation. Such pressures could cause a deformation of the end known as buckling, which occurs when the chuck wall of the end pulls away from the double seam of the can. It is to be noted that spinner-neckers or multistage necking machinery can form a necked-down body of smaller diameter than presently used. Therefore, any use of a necked-down can for a smaller diameter end must be predicated on improved construction of the end itself.

SUMMARY OF THE INVENTION

There is a real and definite need for a can end having a reduced diameter and thickness, combined with structural integrity and an improved opening arrangement. The present invention meets this need and comprises, in essence, the use of a reinforcing triple fold formed as a ring adjacent to the chuck wall of the peripheral rim of the end. A score-cut about the underside of this triple fold permits the center expansion panel of the end to be separated from the triple fold. An uncut portion at the triple fold forms a hinge which holds the panel as a gate so it may be pushed downwardly into the can to open it.

The triple fold has been used as a push-down gate to open a comparatively small orifice in the center expansion panel of a can end as disclosed in the U.S. Pat. No. 3,334,775, issued Aug. 8, 1967. However, the expedient of using a triple fold as a ring to reinforce the chuck wall of the rim and also carry the center panel as a push-down gate solves the problem of buckling of a thin metal can end and at the same time provides an opening large enough for easy pouring or drinking, even with an extremely small diameter end.

In addition to accomplishing this double function the invention has other significant advantages. Perhaps the most important object, from the consumer's viewpoint, is to provide a beverage can which simulates a cup or drinking glass.

Another object of the invention is to provide, in a beverage can simulating a cup or drinking glass that may be opened by pushing the center expansion panel of the end into the can, a structural arrangement which protects the drinker from sharp edges of metal which occur when the can is opened.

Other objects of the invention are to provide a novel and improved can end structure which: allows for a smaller diameter and a thinner unit than would otherwise be possible; is easily stacked and stored; is concentric and radially symmetrical in form to minimize tooling cost and maximize tooling life; is simple in form to minimize the cost of production and requires only one press rather than two presses needed for present stay-on-tab convenience openings; may be made of either steel or aluminum as opposed to ends which presently can only be made from aluminum; eliminates the need for a lever to facilitate opening the panel; minimizes air entrapment within the end when the can is being closed; can be held and opened with one hand; has a minimum concentric circular area of worked metal which needs to be coated with a dielectric resin to function as a sealant and to avoid product exposure to raw metal; and, is a neat appearing unit when on a can body.

FIGURE DESCRIPTION

With the foregoing and other objects in view, my invention comprises certain constructions, combinations and arrangements of parts and elements as hereinafter described, defined in the appended claims, and illustrated in preferred embodiment in the accompanying drawings, in which:

DETAILED DESCRIPTION OF THE INVENTION

Figure 1:
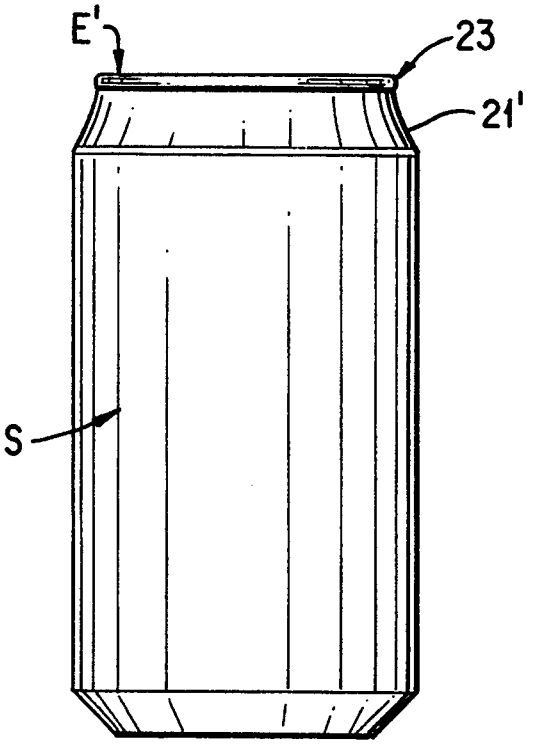
FIG. 1 PRIOR ART
FIG. 1 is an elevational view of a beverage can body having a necked-down top closed by an end and which has the proportions of a common type of beverage can.
Figure 2:
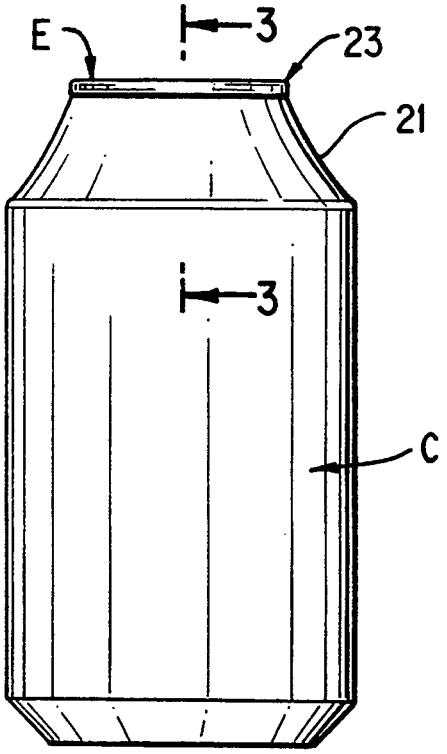
FIG. 2 is an elevational view of a beverage can body similar to FIG. 1 and having the same proportions except for a more extensively necked-down top closed by a smaller, thinner end, in accordance with the present invention.
Figure 3:
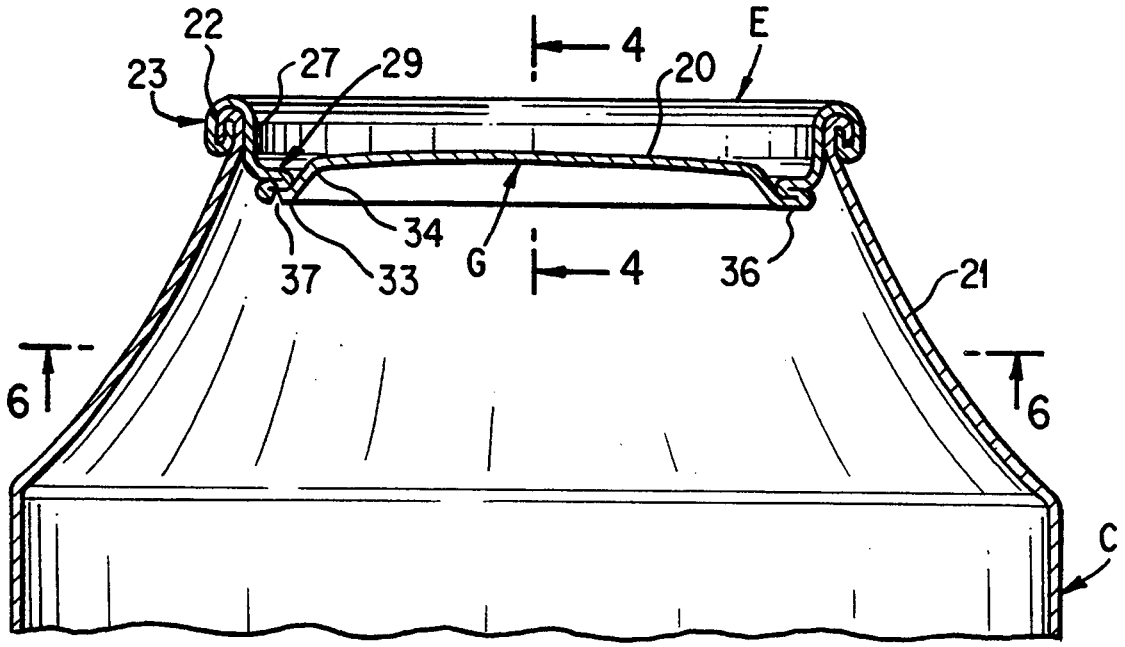
FIG. 3 is a transverse section of the upper portion of the can body of FIG. 2 as taken from the indicated line 3—3 at FIG. 2, but on an enlarged scale.

Referring more particularly to the drawing, FIGS. 1 and 2 illustrate a standard can body S and a modified can body C. The standard can body S is formed of drawn metal, aluminum or steel, with the top being necked-down to be closed by an end E′ slightly smaller in diameter than the can body and which may be a conventional end. The modified can body C is similar to the can body S in all respects except the top is necked-down more extensively, to be closed by a yet smaller-diameter, improved end E. It is to be noted that an improved end E of suitable diameter may be used with either can body. However, the primary use will be for the more extensively necked-down can C of FIG. 2 to obtain the advantage of reducing the amount of metal needed to manufacture the end.

Figure 7:
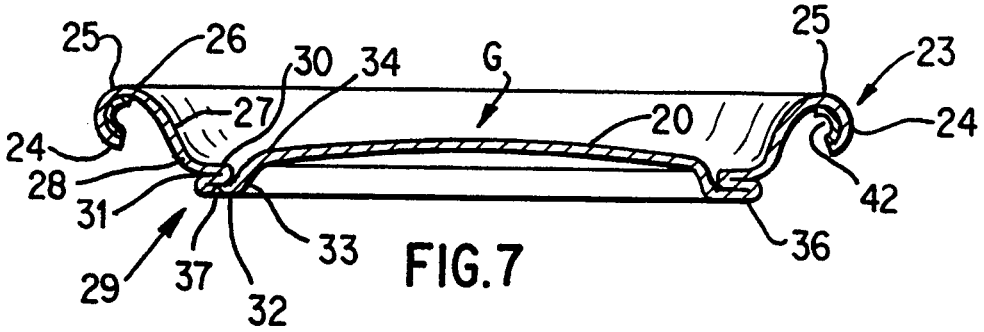
FIG. 7 is a transverse sectional view of the improved can end before the same is seamed onto the top of the beverage can.
Figure 8:
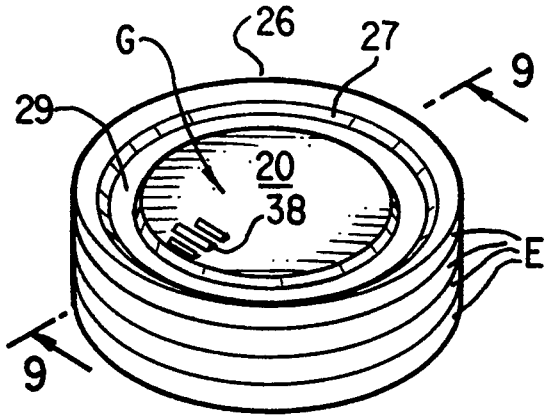
FIG. 8 is an isometric view of a group of nested ends such as shown at FIG. 7 but on a reduced scale.
Figure 9:
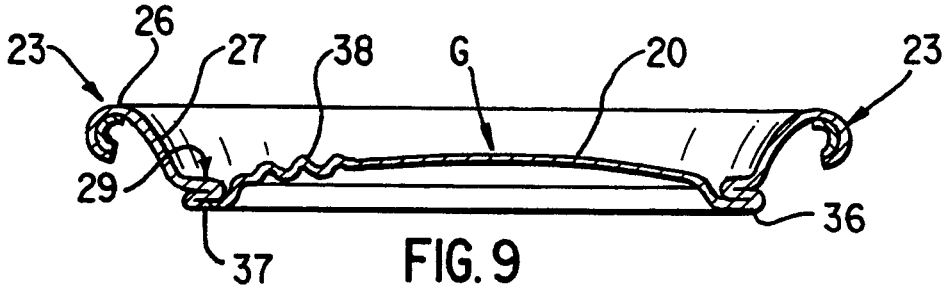
FIG. 9 is a transverse sectional view of an end as taken from the indicated line 9—9 at FIG. 8 but on an enlarged scale, to illustrate finger corrugations on the central expansion panel.

FIGS. 3 to 6 illustrate an improved end E as being attached to the necked-down can C, while FIGS. 7 to 9 illustrate the structure of the end E before it is seamed onto the top of the can. The end E is formed as a circular disc with a central expansion panel 20 and with peripheral rim components being circular about this panel for easy forming and drawing with comparatively simple tooling. The expansion panel 20 may be flat or slightly arched, as illustrated, to better resist pressure within the can.

Figure 4:
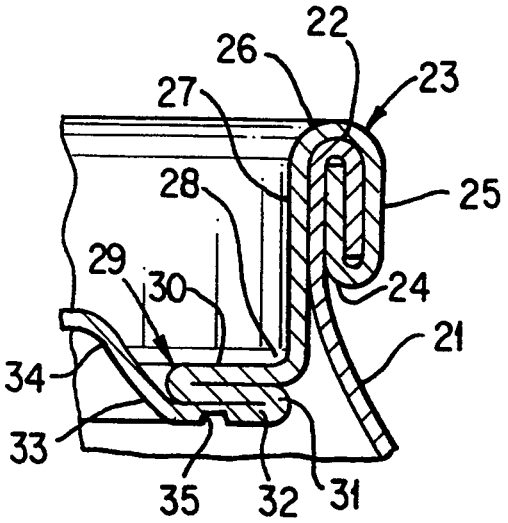
FIG. 4 is a fragmentary sectional detail as taken from the indicated line 4—4 at FIG. 3 but on a further enlarged scale.
Figure 5:
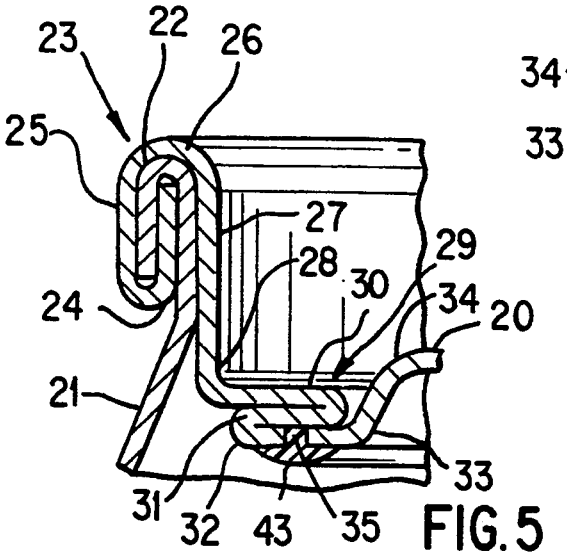
FIG. 5 is a fragmentary sectional detail similar to FIG. 4 but showing another portion of the can end.
Figure 6:
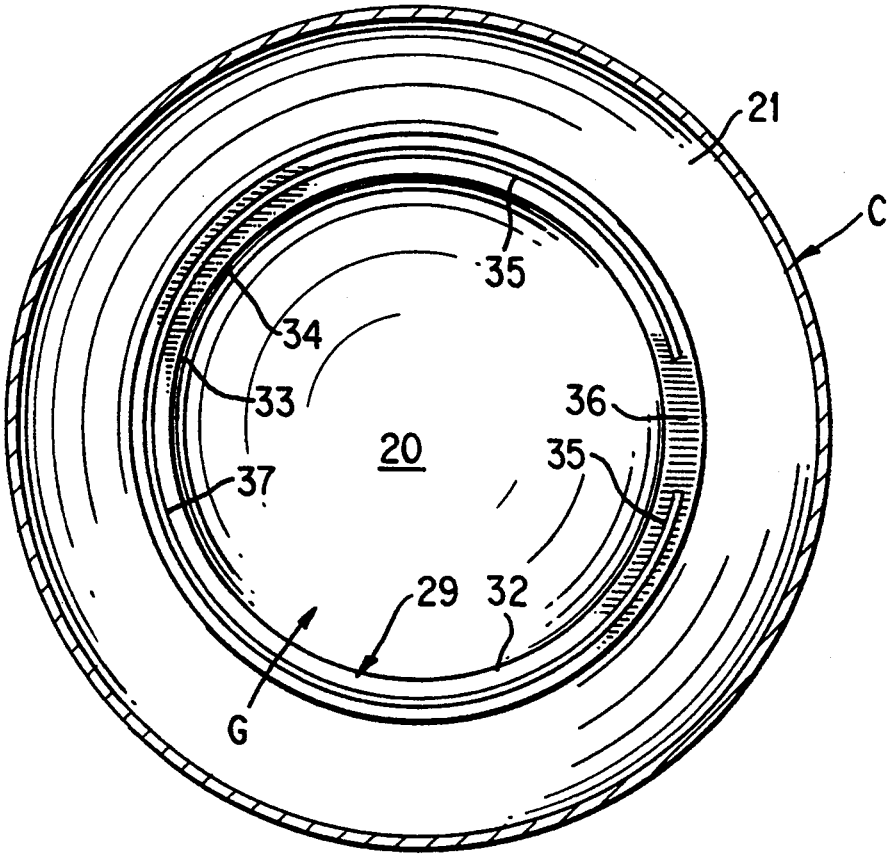
FIG. 6 is a bottom view as taken from the indicated line 6—6 at FIG. 3.

The top of the can body C and the peripheral seaming rim portion of the end E, where connection is made to the can body, are conventional. The can body C is necked-down as at 21 to reduce the diameter of the opening to receive the end E. A double seam body hook 22 at the top edge of the necked-down portion 21 is interlocked with an end hook 23 of the seaming rim portion to form a conventional double seam. As best shown at FIG. 4, the peripheral portion of the end hook 23 forms an end curl 24 which, when seamed with the body hook 22, is embraced by the body hook. A seaming panel 25 adjacent to the curl 24 wraps about the body hook 22 with a top seaming panel radius 26 extending over the body hook 22 and to an inside chuck wall 27 alongside the can wall.

In a conventional end, a chuck panel turns inwardly from the base of the chuck wall 27 at a chuck radius 28. In the improved end E a tight ring-shaped triple fold 29 replaces the chuck panel. This triple fold 29 includes an upper ring-shaped layer 30, extending inwardly from the chuck radius 28. Thence, the metal forming the end folds 180 degrees to extend outwardly as an intermediate ring-shaped layer 31, to terminate below and adjacent to the chuck radius 28. Thence, the metal folds 180 degrees to extend inwardly as a bottom layer 32. This layer 32 extends as a chuck panel radius 33 at the inner edge of the triple fold 29 and turns upwardly and inwardly a short distance to a center panel radius 34 which turns inwardly to the center panel 20.

Figure 15:
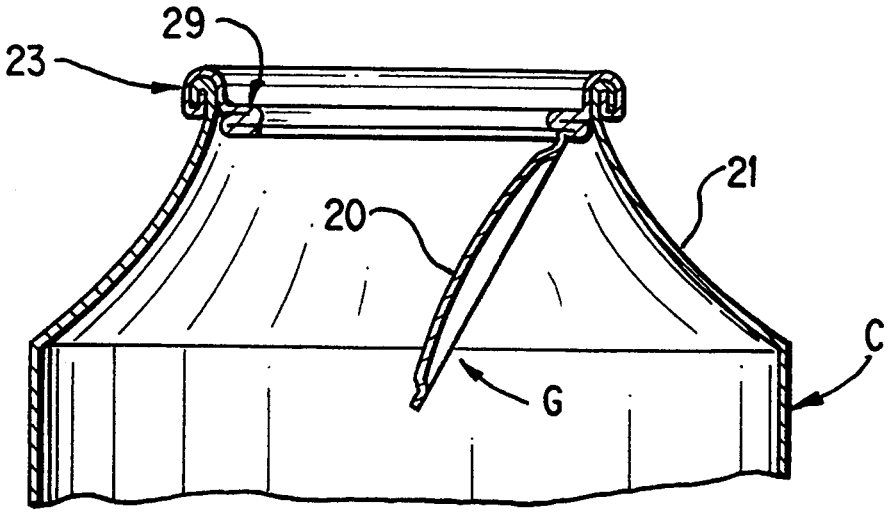
FIG. 15 is a sectional detail as taken from the indicated line 15—15 at FIG. 14 but with the gate being opened.
Figure 17:
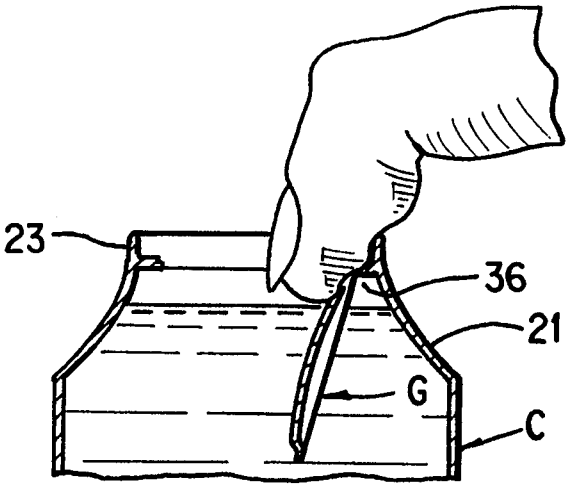
FIG. 17 is a somewhat diagrammatic view similar to FIG. 16 but with the position of an individual's finger when the gate is opened.
Figure 16:
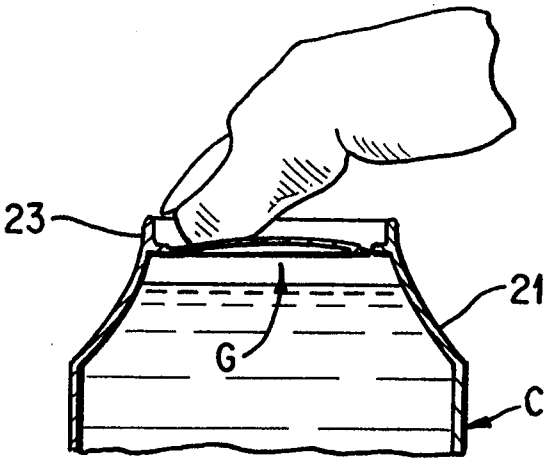
FIG. 16 is a sectional view similar to FIG. 15 but on a reduced scale and with an individual's finger in position at the initiation of the opening of the gate.
Figure 18:
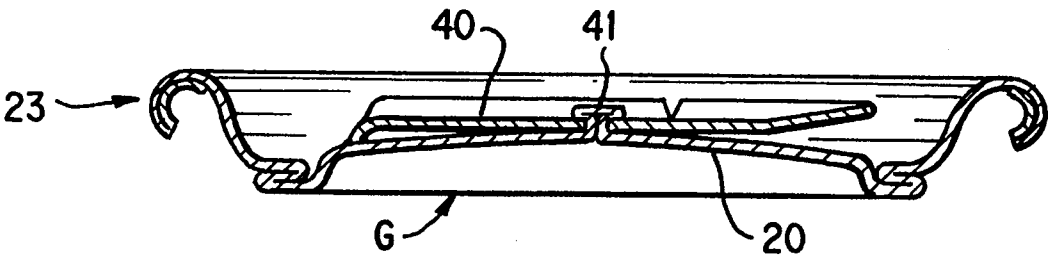
FIG. 18 is a transverse sectional view similar to FIG. 7 but with lever attached to the expansion panel to facilitate opening as a push-down gate.

A score-cut 35 is at the underside of the bottom layer 32 of the triple fold and extends about the triple fold to form a gate G consisting of the center panel 20, the center panel radius 34, the chuck panel radius and the inner portion of the bottom layer 32. A short, uncut section of the bottom layer forms a hinge 36. Thus, a can with the end E may be opened by simply pushing downwardly against this; gate G to sever the gate at the score-cut and permit it to move downwardly and into the can as illustrated at FIGS. 15, 16 and 17. With the hinge 36, the gate G, when opened, will remain attached to the peripheral portion of the end, and within the can to which the end is attached. This structure thus complies with environmental and safety concerns for beverage can use.

The depth of the score-cut 35 into the bottom layer of the triple fold is carefully monitored so that enough metal remains at the score-cut to prevent a tension rupture and buckling of the center panel 20 when the contents of the can are pressurized. At the same time, however, the metal remaining must be thin enough to easily tear when the panel is pushed downwardly. To facilitate initiation of this tearing action a short portion of the score-cut 35, preferably diametrically opposite the hinge 36, may be cut completely through the metal, as at 37. This score-cut and through-cut requires a sealant, as hereinafter described.

To effectively open the center panel 20 a downward pressure on the panel 20 adjacent to the cut 37 may be applied by simple finger pressure, as in the manner illustrated at FIG. 16. The first movement of the gate, at the cut 37, will effect a release of any gas pressure built up within the can. Then the panel may be severed at the score, by a tearing action. As this proceeds the individual's finger may be moved toward the hinge in a manner which will keep his finger above the contents of the container, there usually being an air gap of approximately one-fourth inch in a container such as illustrated at FIGS. 16 and 17. To facilitate proper location and pushing of an individual's finger against the gate G, especially at the start of the opening of the gate, the panel 20 may be modified by forming a boss or small corrugations 38 closely adjacent to the cut-through score portion 37, as illustrated at FIGS. 8 and 9.

The manual operation to open the center panel gate G as above described is quite satisfactory. However, it is also possible to open this panel with a lever assist. The opening of the gate G may be facilitated by affixing a lever 40 to the gate as with a rivet 41, formed by drawing the center of the panel 20. This expedient is well known to the art, and while the rivet is preferably at the center of the panel, it may be located otherwise.

Figure 10:
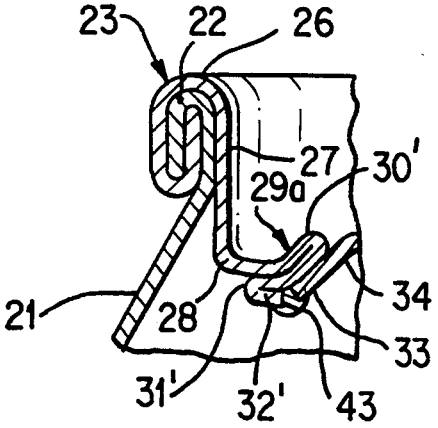
FIG. 10 is a fragmentary sectional detail similar to FIGS. 4 and 5, but illustrating a modified arrangement of the components therein.
Figure 11:
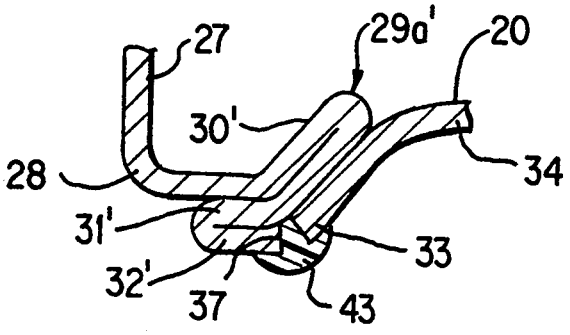
FIG. 11 is a fragmentary detailed portion of the snowing at FIG. 10 on a further enlarged scale to better illustrate a manner of sealing a score-cut extending through the metal wall.

The triple fold 29 as heretofore described, lies below and close to the chuck wall 27 to substantially enhance the rigidity and strength of the end E and its connection to the top of the can C. This permits a thinner metal to be used in formation of the end. A variation of this construction is shown at FIGS. 10 and 11 where the triple fold 29*a* is folded and is located partially at the chuck panel site and partially at the chuck panel radius 33 which turns upwardly from the panel. This folded triple fold 29*a* will further rigidify the end. This variation is especially desirable where the chuck panel space, formed by the triple fold 29*a* is quite narrow.

It is to be noted that a sealant 42, FIG. 7, is applied to the end curl 24 and seaming panel 25 of the end hook 23 when the end is manufactured, usually by spinning the end E with a nozzle applying the sealant as the end rotates. It is desirable to apply a protective layer of resin 43 over the score-cut 35, FIG. 5, which can function as a dielectric sealant, both to seal the cut-through portion 37 and to protect the contents of the can from raw metal at the score-cut 35. The resin 43 may be applied about the score-cut 35 from a nozzle at the same time the sealing panel sealant 42 is applied. Such an operation is well known to the art and need not be described in detail.

Figure 12:
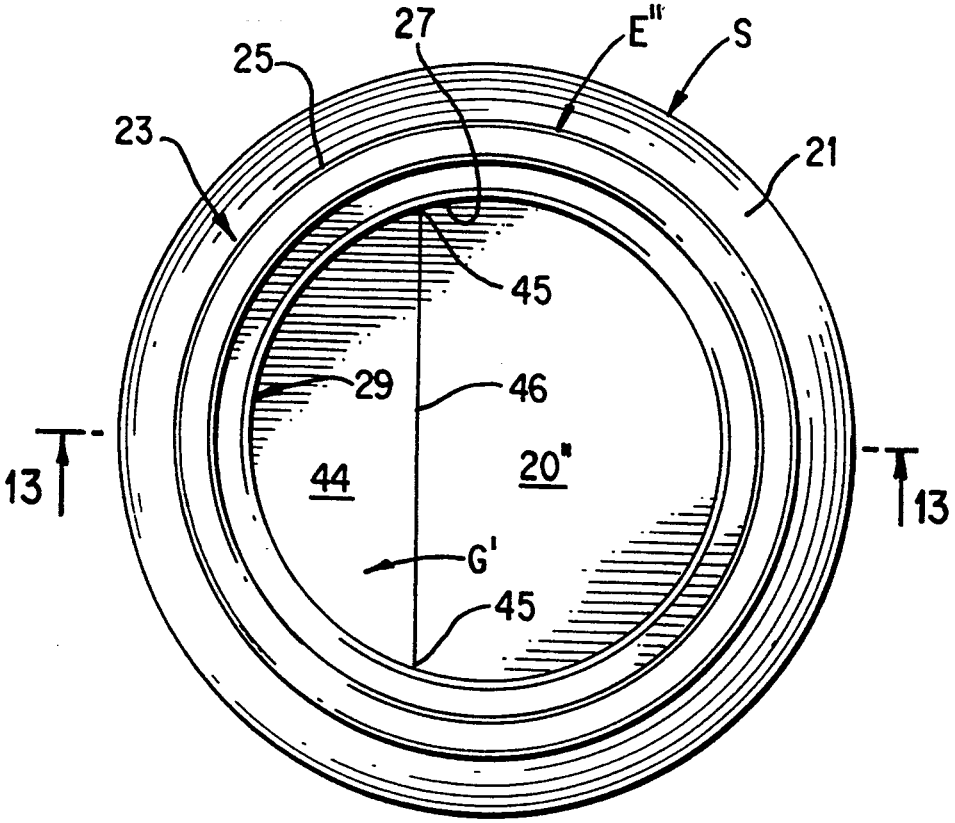
FIG. 12 is a top view of a beverage can of conventional proportions, such as shown at FIG. 1, with an improved end thereon and having a hinge line extending across the expansion panel of the end to provide a partial gate opening.
Figure 13:
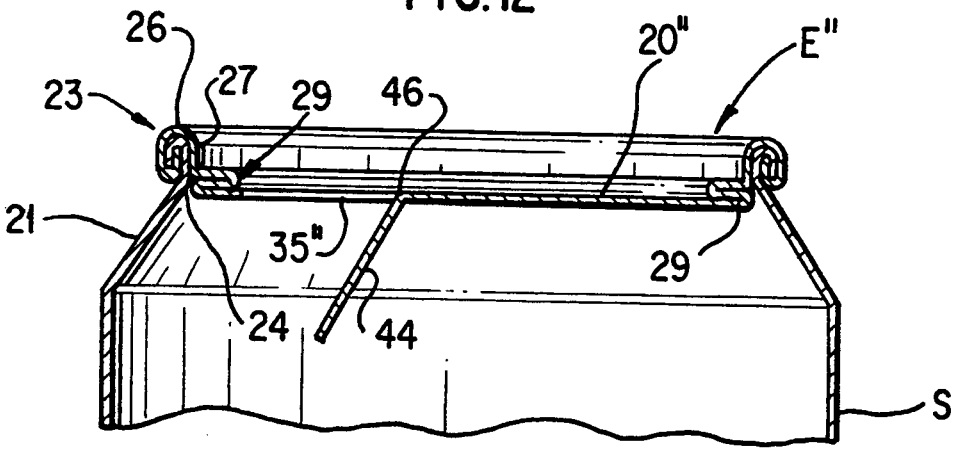
FIG. 13 is a transverse section as taken from the indicated line 13—13 at FIG. 12 but with the gate portion being opened.
Figure 14:
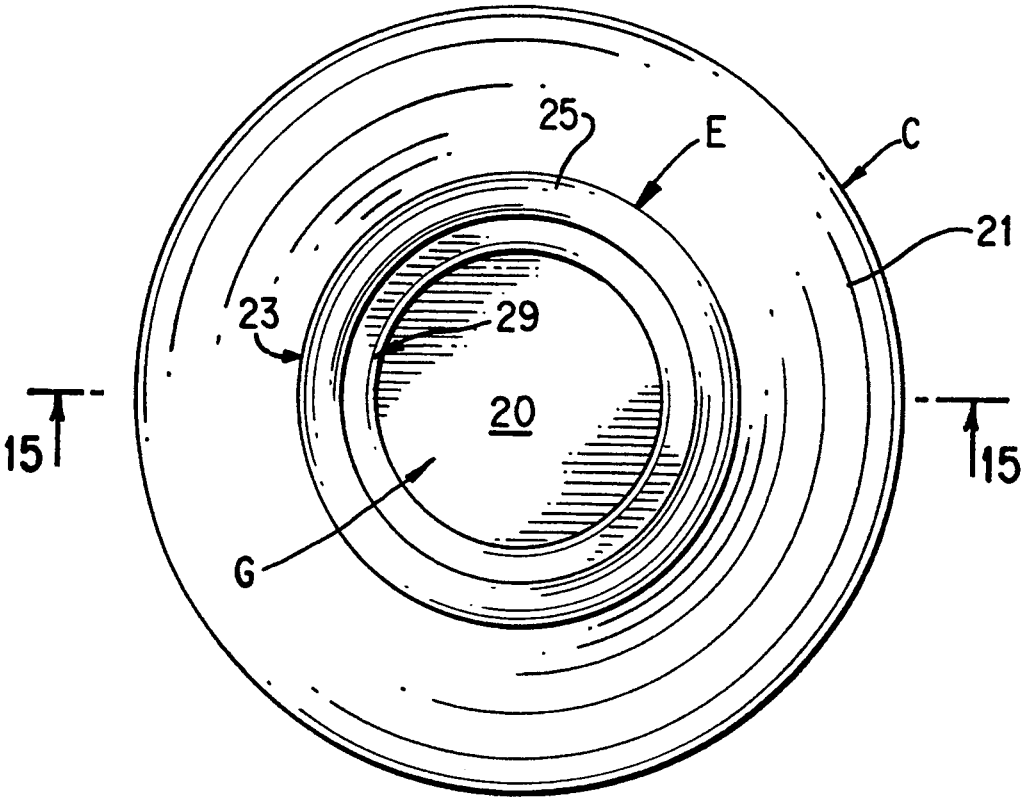
FIG. 14 is a top view of a beverage can having a necked-down top such as shown at FIG. 2, with the improved end thereon and with the gate formed by the central expansion panel as being closed.

A modification of the invention, shown at FIGS. 12 and 13, provides for an end E″ where it is desirable to permit only a portion of the center expansion panel 20″ to be pushed downwardly into a can as a gate 44. The triple fold ring 29 is the same as heretofore described, being positioned to reinforce the seamed rim connecting the end to the can body. However, the score-cut 35″ is restricted to only a sector of the triple fold sufficient to define the gate 44 terminating at points 45, FIG. 12. When the gate 44 is pushed downwardly and severed from the triple fold at the score-cut 35″ the comparatively thin metal of the center expansion panel 20″ will flex and fold as a hinge generally at line 4 between the end points 45 of the score-cut. An indentation at line 46 may be cut, pressed or otherwise formed in the center expansion panel to better define the hinge line 46 and facilitate, by easy folding, the formation of the gate 44.

This modified construction is useful for beverage cans having larger openings where it may be desirable to restrict the immersion of the gate into the contents. It may be used with a standard beverage can S having a limited necked-down portion 21″ at its top. It also may be used with a beverage can having a cylindrical wall without a necked-down top (not shown). In fact, with such a cylindrical construction, an end having the entire center expansion panel forming a gate could not be used because the sides of the gate would engage the walls of the can.

I have now described my invention in considerable detail. It is obvious that others skilled in the art can devise and build alternate and equivalent constructions which are within the spirit and scope of my invention. Therefore, I desire that my protection be limited, not by the constructions illustrated and described, but only by the proper scope of the appended claims.

I claim:

1. In a can end of formed sheet metal with a peripheral connection means about a center expansion panel of the can end, including a curl, a seaming panel and an inward chuck wall adapted to fit upon the open top of a can to form a seamed rim, with the chuck wall at the inner side of the can wall having an inwardly turned radius at its base, the improvement comprising;

(a) a tightly folded, ring-shaped triple fold having an upper layer extending inwardly from the chuck wall radius, an outwardly folded intermediate layer and an inwardly folded bottom layer with the metal at the inner edge of the bottom layer extending to the center expansion panel and, (b) a score-cut at the underside of said bottom layer extended partially through the bottom layer adapted to permit the center expansion panel to be moved downwardly and severed from the triple fold.

2. The can end defined in claim 1, wherein the outward portion of the triple fold constitutes a chuck panel and wherein the inward portion of the triple fold extends inwardly and upwardly to form a chuck panel radius connecting with the center expansion panel.

3. The can end defined in claim 1, which additionally comprises a sealant at the underside of the bottom layer of the triple fold covering and sealing the score cut.

4. The can end defined in claim 1 wherein the score-cut extends partially about the underside of the triple fold, and a hinge is formed across the center expansion panel from opposite ends of the partial score-cut when the scored portion of the center expansion panel is severed and pushed downwardly as a gate.

5. The can end defined in claim 4, wherein there is an indentation across the center expansion panel from opposite ends of the partial score-cut to facilitate the formation of said hinge.

6. The can end defined in claim 1 wherein the score-cut extends substantially around said bottom layer and with a short portion forming a hinge, which permits the center expansion panel to function as a gate to be pushed downwardly to open as said score-cut is severed but to remain attached to the triple fold at the hinge.

7. The can end defined in claim 6 wherein a portion of the score-cut is extended completely through said bottom layer to facilitate severing the center expansion panel from the triple fold as it is pushed downwardly.

8. The can end defined in claim 7 wherein the scored-through portion of the score-cut is diametrically opposite to the hinge.

9. The can end defined in claim 8 including a finger gripping boss adjacent to said scored-through portion to facilitate manual separation and downward movement of the expansion panel from the bottom layer of the triple fold at the score-cut.

10. In combination, a beverage can having cylindrical side-wall and a necked-down top portion reducing the diameter of the opening at the top of the can and a can end with a peripheral connection means about a center expansion panel of the end connecting the can end to the can body, the improvement comprising:

(a) a tightly-folded, ring-shaped triple fold extended about the can end between the connection means and the center expansion panel, with an upper layer extending inwardly from the connection means, an outwardly folded intermediate layer and an inwardly folded bottom layer extending to the center expansion panel, and (b) a score-cut at the underside of said bottom layer partially extended through the bottom layer and adapted to permit the center expansion panel to be severed from the peripheral connection means and the triple fold and moved downwardly to open the can.

11. The combination defined in claim 10 wherein the metal extending from the bottom layer of the triple fold turns upwardly and inwardly placing the center expansion panel above the triple fold.

12. The combination defined in claim 10 wherein the score-cut extends partially under the triple fold to opposing sides thereof and a hinge line extends across the expansion panel from said opposing sides permitting the scored portion of the expansion panel to be severed and pushed downwardly as a gate, being hinged at said hinge line.

13. The can end defined in claim 10, which additionally comprises a sealant at the underside of the bottom layer of the triple fold covering and sealing the score cut.

14. The combination defined in claim 10 wherein said score-cut extends substantially around said inwardly folded bottom layer of the triple fold with a short uncut portion forming a hinge to permit the central expansion panel to function as a gate when pushed downwardly.

15. The combination defined in claim 14 wherein a portion of the score-cut opposite the hinge is cut completely through the bottom layer of the triple fold to facilitate severing the center expansion panel from the triple fold as it is pushed downwardly.

16. The can end defined in claim 15 including a boss upstanding from the surface of the center expansion panel adjacent to said cut-through portion.

17. In combination, a beverage can having a cylindrical sidewall and an open top, and a can end with a peripheral connection means about a center expansion panel, the improvement comprising:

(a) a tightly-folded, ring-shaped triple fold extended about the can end between said connection means and said center expansion panel, with an upper layer extending inwardly from the connection means, an outwardly folded intermediate layer and an inwardly folded bottom layer extending to the center expansion panel, and (b) a score-cut at the underside of said bottom layer partially extended through the bottom layer to encompass a sector of the center expansion panel defining a gate in the center expansion panel, wherein a hinge is formed across the center expansion panel between the opposite ends of the score-cut when said gate portion is pushed downwardly into the can.

18. The can defined in claim 17 wherein there is an indentation across the center expansion panel from opposite ends of said score cut sector to facilitate the formation of said hinge.

19. The can end defined in claim 17, which additionally comprises a sealant at the underside of the bottom layer of the triple fold covering and sealing the score cut.

* * * * *